US005398870A

United States Patent [19]

Bienaime

[11] Patent Number: 5,398,870

[45] Date of Patent: Mar. 21, 1995

[54] OUTER PACK

[75] Inventor: Patrick Bienaime, Milly sur Therain, France

[73] Assignee: 4P Emballages France, Beauvaix Cedex, France

[21] Appl. No.: 136,779

[22] Filed: Oct. 14, 1993

[51] Int. Cl.[6] ..... B65D 5/42

[52] U.S. Cl. ..... 229/198.2; 229/103.2

[58] Field of Search ..... 229/40, 198.2; 206/427

[56] References Cited

U.S. PATENT DOCUMENTS

| | | | |
|---|---|---|---|
| 3,194,476 | 7/1965 | Weiss | 229/40 |
| 3,269,531 | 8/1966 | Weiss | 229/40 |
| 3,270,944 | 9/1966 | Baker | 229/40 |
| 3,375,968 | 4/1968 | Weiss | 229/40 |
| 3,589,593 | 6/1971 | Weiss | 229/40 |
| 3,652,005 | 3/1972 | Morgese | 229/40 |
| 3,767,042 | 10/1973 | Ganz | 229/40 |
| 3,797,729 | 3/1974 | Holmes | 229/40 |
| 3,977,518 | 8/1976 | Arneson | 229/40 |
| 4,049,189 | 9/1977 | Wood | 229/40 |
| 4,708,284 | 11/1987 | Sutherland et al. | 229/40 |

*Primary Examiner*—Gary E. Elkins
*Attorney, Agent, or Firm*—Michael J. Striker

[57] ABSTRACT

An outer pack for wrapping around at least one object has a top panel, two side panels, two base panel sections at least partially overlapping one another and forming a base, and a structure for connecting the base panel sections with one another. The connecting structure includes a plurality of hook-shaped closure elements provided in one of the base panel sections and composed substantially of two sections located one behind the other and including an inner section hinged to the one base panel section along a folding line and interrupted by a cut curving into the one base panel section and forming a projection, and an outer section hinged to the inner section along a further folding line with both sections having a substantially trapezoidal shape. The connecting structure further includes a plurality of openings provided in another of the base panel sections and each having an outer defining edge extending straight and substantially parallel to an outside edge of the other base panel section, two edges extending from both ends of the outer defining edge and inclined inwardly toward one another, two further edges extending from the first mentioned edges away from each other and an inner defining edge extending substantially parallel to the outer defining edge and having extensions formed as cuts.

5 Claims, 1 Drawing Sheet

OUTER PACK

BACKGROUND OF THE INVENTION

The present invention relates to an outer pack made preferably from board for wrapping around at least one object.

More particularly, it relates to an outer pack which has a top panel, two side panels and two base panel sections that overlap to at least some extent and form a base of the outer pack.

Outer packs of the above-mentioned general type are known in the art. A known outer pack is formed so that one base panel has openings while the other base panel has hook-shaped closure elements which engage the openings to join the two base panel sections together. European patent document EP-PS 0 233 078 discloses such an outer pack. In this pack an opening in the shape of a circular segment and a slit arrangement are provided to engage a hook-shaped closure element. It is extremely complicated and laborious to fit the hook-shaped closure element into the opening/slit.

SUMMARY OF THE INVENTION

Accordingly, it is an object of the present invention to provide an outer pack which avoids the disadvantages of the prior art.

More particularly, it is an object of the present invention to provide an outer pack in which a hook-shaped closure element can be locked simply in place and at the same time, reliable closure of the pack is guaranteed.

In keeping with these objects and with others which will become apparent hereinafter, one feature of the present invention resides, briefly stated, in an outer pack in which one base panel section is provided with hook-shaped closure elements each having two sections located behind each other and including an inner section which is hinged to the one base panel section along a folding line having a cut which curves into the one base panel section so as to form a projection while the outer section is hinged to the inner section along a further folding line and both sections have a substantially trapezoidal shape, whereas the other base panel section has an opening defined by an edge extending straight and parallel to an outside edge of the other base panel section and continued at both ends by two edges inclined toward each other and extending inward and further two edges extending from the first two edges away from each other and connected by an inner defining edge extending substantially parallel to the first mentioned defining edge with cut lines provided as extensions of the further two edges.

When the outer pack is formed in accordance with the present invention, it is particularly easy to close the pack without the need of extensive equipment.

In accordance with a further feature of the present invention, two recesses are provided on both sides in the area of the second folding line between the inner section and the outer section of each closure element of the one base panel section.

In accordance with still a further feature of the present invention, the inner defining edge of the other base panel is bent at both sides toward the further edges which extend away from each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figures 1, 2:
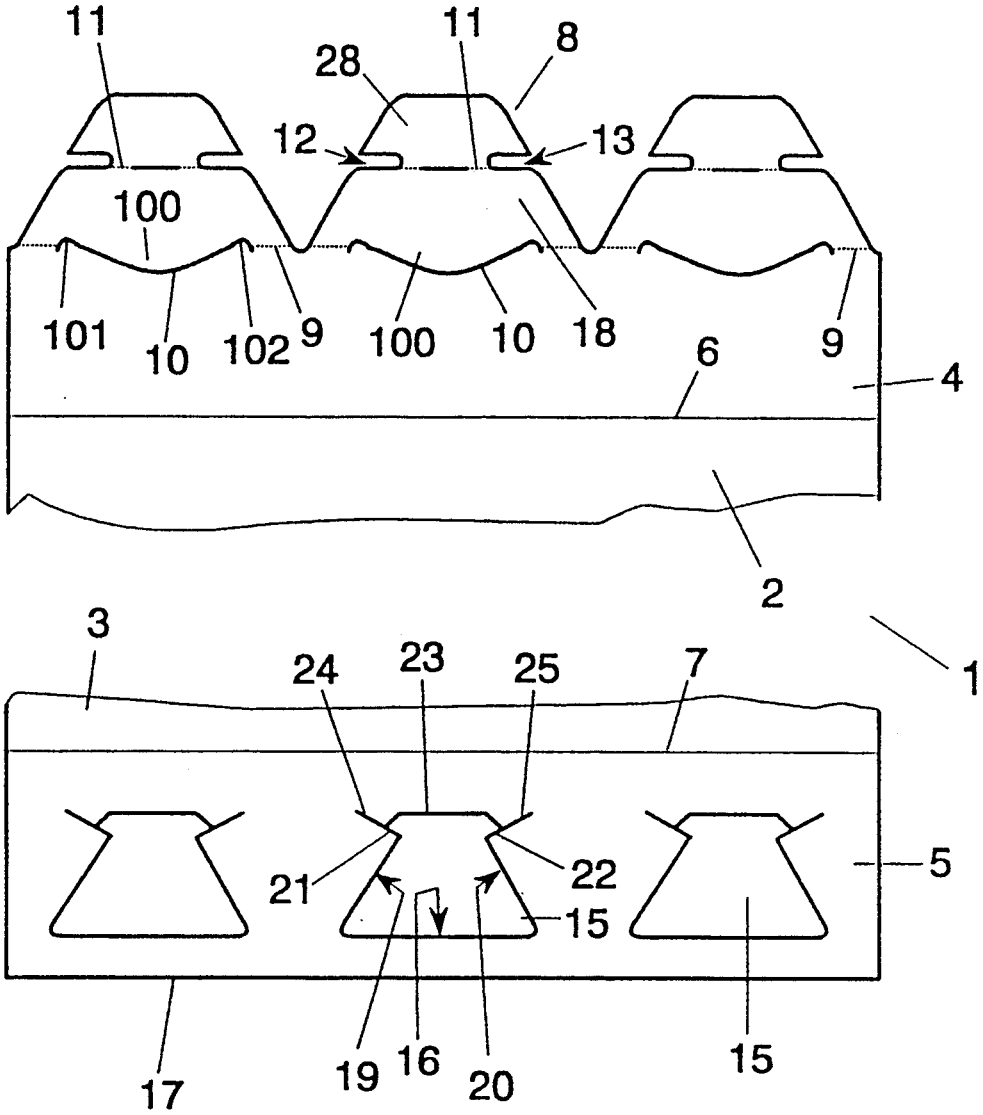
FIG. 1 is a view showing a first side panel and a first base panel section of a blank for the outer pack in accordance with the present invention.
FIG. 2 is a view showing a second side panels and a second base panel section of a blank for the outer pack in accordance with the present invention.

A flat blank in accordance with the present invention is identified as a whole with reference numeral 1. It can be made of board. The flat blank 1 has a top panel, two side panels 2 and 3, and a base panel composed of two base panel sections 4 and 5, respectively shown in FIGS. 1 and 2. The side panels 2 and 3 are hinged to the top panel. The base panel sections 4 and 5 are each hinged to the side panels 2 and 3 along folding lines 6 and 7 correspondingly.

Three hook-shaped closure elements 8 extend from the base panel section 4, and in particular from the end which is opposite to the folding line 6. The closure elements 8 are hinged along a folding line 9 to the base panel section 4. In the middle of each closure element 8 the folding line 9 is interrupted by a cut 10 which curves into the base panel section 4 so as to form a projection 100. Each closure element 8 consists of two sections 18 and 28 which are located one behind the other and connected with one another along a further folding line 11. Recesses 12 and 13 are provided in the course of the folding line 11 at both sides from outside inwardly between the sections 18 and 28 of the closure element 8. The sections 18 and 28 of the closure element 8 are substantially trapezoidal in shape.

The other base panel 5 is provided with three openings 15 for accommodating the three closure elements 8. Each opening 15 has a defining edge 16 extending parallel to an outer edge 17 of the base panel section 5. Two edges 19 and 20 extend from the ends of the defining edge 16 inwardly and are inclined toward one another. Two further edges 21 and 22 extend from the inner ends of the edges 19 and 20 away from one another. The further edges 21 and 22 are connected with one another by an inner defining edge 23 which extends substantially parallel to the first defining edge 16. The inner defining edge 23 has two end sections which are bent toward the edges 21 and 22 and extend away from each other. Cut lines 24 and 25 are further formed as extensions of the edges 21 and 22 which extend away from each other.

In assembled condition, the outer section 28 of the hook-shaped closure element engages in the cut lines 24 and 25. When the two base panel sections 4 and 5 are locked together, the end sections 101 and 102 of the curved cut end rest against the defining edge 16, while the projection 100 at the same time rests against the base panel section 5.

It will be understood that each of the elements described above, or two or more together, may also find a useful application in other types of constructions differing from the types described above.

While the invention has been illustrated and described as embodied in an outer pack made from board for wrapping around at least one object, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An outer pack for wrapping around at least one object, comprising a top panel; two side panels; two base panel sections at least partially overlapping one another and forming a base; and means for connecting said base panel sections with one another, said means including a plurality of integral substantially trapezoidal hook-shaped closure elements provided in one of said base panel sections and having substantially two sections located one behind the other and including an inner section hinged to said one base panel section along a folding line and interrupted by a curved cut curving into said one base panel section and forming a projection, and an outer section hinged to said inner section along a further folding line with both sections having a substantially trapezoidal shape, said two sections of each of said closure elements having two sides formed so that each side of one of said sections and a corresponding side of another of said sections of the same closure element are located on a single inclined straight line, said connecting means further including a plurality of openings provided in another base panel section which is uninterrupted with the exception of said openings and each having an outer defining edge extending through and substantially parallel to an outside edge of said other base panel section, two edges extending from both ends of said outer defining edge and inclined inwardly toward one another, two further edges extending from said first mentioned edges away from each other and an inner defining edge extending substantially parallel to said outer defining edge, said two further edges having extensions formed as cuts.

2. An outer pack as defined in claim 1, wherein said panels are composed of board.

3. An outer pack as defined in claim 1, wherein said base panel sections are hinged to said side panels.

4. An outer pack as defined in claim 1, wherein each of said hook-shaped closure elements is provided with two recesses extending from outside inwardly along a portion of said folding line.

5. An outer pack as defined in claim 1, wherein said inner defining edge has two end sections which are bent toward said further edges extending away from each other.

* * * * *